US008620177B2

(12) United States Patent
Carot

(10) Patent No.: US 8,620,177 B2
(45) Date of Patent: Dec. 31, 2013

(54) DEVELOPING DEVICE WITH SEAL MEMBERS

(75) Inventor: Juan Torres Carot, Wrexham (GB)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 347 days.

(21) Appl. No.: 13/071,476

(22) Filed: Mar. 24, 2011

(65) Prior Publication Data

US 2012/0243901 A1 Sep. 27, 2012

(51) Int. Cl.
*G03G 15/08* (2006.01)

(52) U.S. Cl.
USPC ..... 399/103

(58) Field of Classification Search
USPC ..... 399/103, 102
See application file for complete search history.

(56) References Cited

U.S. PATENT DOCUMENTS

2005/0180774 A1 8/2005 Ohgoshi et al.
2011/0236057 A1* 9/2011 Nakajima et al. ..... 399/103

FOREIGN PATENT DOCUMENTS

JP 62208073 A * 9/1987
JP 2005-234144 A 9/2005
JP 2008-052226 A 3/2008

* cited by examiner

*Primary Examiner* — Quana M Grainger
(74) *Attorney, Agent, or Firm* — Baker Botts L.L.P.

(57) ABSTRACT

A developing device includes a seal member adhered to a frame along an axial direction of a developing roller. The seal member seals between the frame and an outer peripheral surface of the developing roller. The frame has a seal supporting surface extending along the axial direction, on which the seal member is supported in a cantilevered fashion. The seal member includes a sheet-like member and an elastic adhesive member. One end portion of the sheet-like member is fixed to the seal supporting surface through the elastic adhesive member, and the other end portion is in contact with the outer peripheral surface of the developing roller. The elastic adhesive member has a first surface adhered to the sheet-like member and a second surface adhered to the seal supporting surface, and at least one slit is formed along the axial direction from the second surface toward the first surface.

10 Claims, 10 Drawing Sheets

DEVELOPING DEVICE WITH SEAL MEMBERS

BACKGROUND OF THE INVENTION

1. Field of the Invention

The present invention relates to a developing device with sealing provided at a periphery of a developer supply opening.

2. Description of Related Art

A developing cartridge generally includes a frame having a toner storage portion for storing toner and a longitudinal toner supply opening from which the toner stored in the toner storage portion is supplied, a supply roller extending along the toner supply opening and rotatably supported on the frame within the toner storage portion, and a developing roller extending along the toner supply opening and rotatably supported on the frame outside the toner storage portion such that toner is supplied from the supply roller to the developing roller.

For the purpose of preventing toner leakage from the developing cartridge, the periphery of the toner supply opening is generally sealed by a sheet-like seal member. This seal member is fixed at its one end to the frame through a double-sided adhesive tape adhered along the one end of the seal member, and contacts at its other end with the outer periphery of the developing roller. Namely, the seal member is supported in a cantilevered fashion by the one end fixed to the frame, which serves as a fixed support, and bridges and seals between the frame and the outer periphery of the developing roller.

However, the seal member is always in contact by pressure with the developing roller, and deflection of the seal member resulting from this pressing force causes the double-sided adhesive tape to peel off from the frame. If the seal member partly peels off from the frame, toner leakage may occur.

In order to eliminate this disadvantage, it may be conceivable that the area of the double-sided adhesive tape is increased to prevent peeling of the tape. However, there is also a requirement to reduce the size of the developing cartridge, which makes it difficult to provide a large adhesion surface on the frame around the developing roller.

In view of the above, it would be desirable to provide a developing device comprising a seal member which is configured to suppress peeling of an adhesive member from the adhesion surface of the frame without increasing the area of the adhesion surface.

SUMMARY OF THE INVENTION

According to the present invention, there is provided a developing device comprising: a developing roller; a frame including a developer storage portion configured to store developer, and a developer supply opening in communication with the developer storage portion and extending along an axial direction of the developing roller; and a seal member configured to seal between the frame and an outer peripheral surface of the developing roller, the seal member being provided on the frame and extending along the axial direction of the developing roller, wherein the frame has a seal supporting surface extending along the axial direction of the developing roller, on which the seal member is supported in a cantilevered fashion, wherein the seal member comprises a sheet-like member and an elastic adhesive member having elasticity, and the sheet-like member has one end portion fixed to the seal supporting surface through the elastic adhesive member and the other end portion in contact with the outer peripheral surface of the developing roller, and wherein the elastic adhesive member has a first surface adhered to the sheet-like member and a second surface adhered to the seal supporting surface, and at least one slit is formed along the axial direction of the developing roller from the second surface toward the first surface.

BRIEF DESCRIPTION OF THE DRAWINGS

To better understand the claimed invention, and to show how the same may be carried into effect, reference will now be made, by way of example only, to the accompanying drawings, in which:

DETAILED DESCRIPTION OF EXEMPLARY EMBODIMENTS

Figure 1:
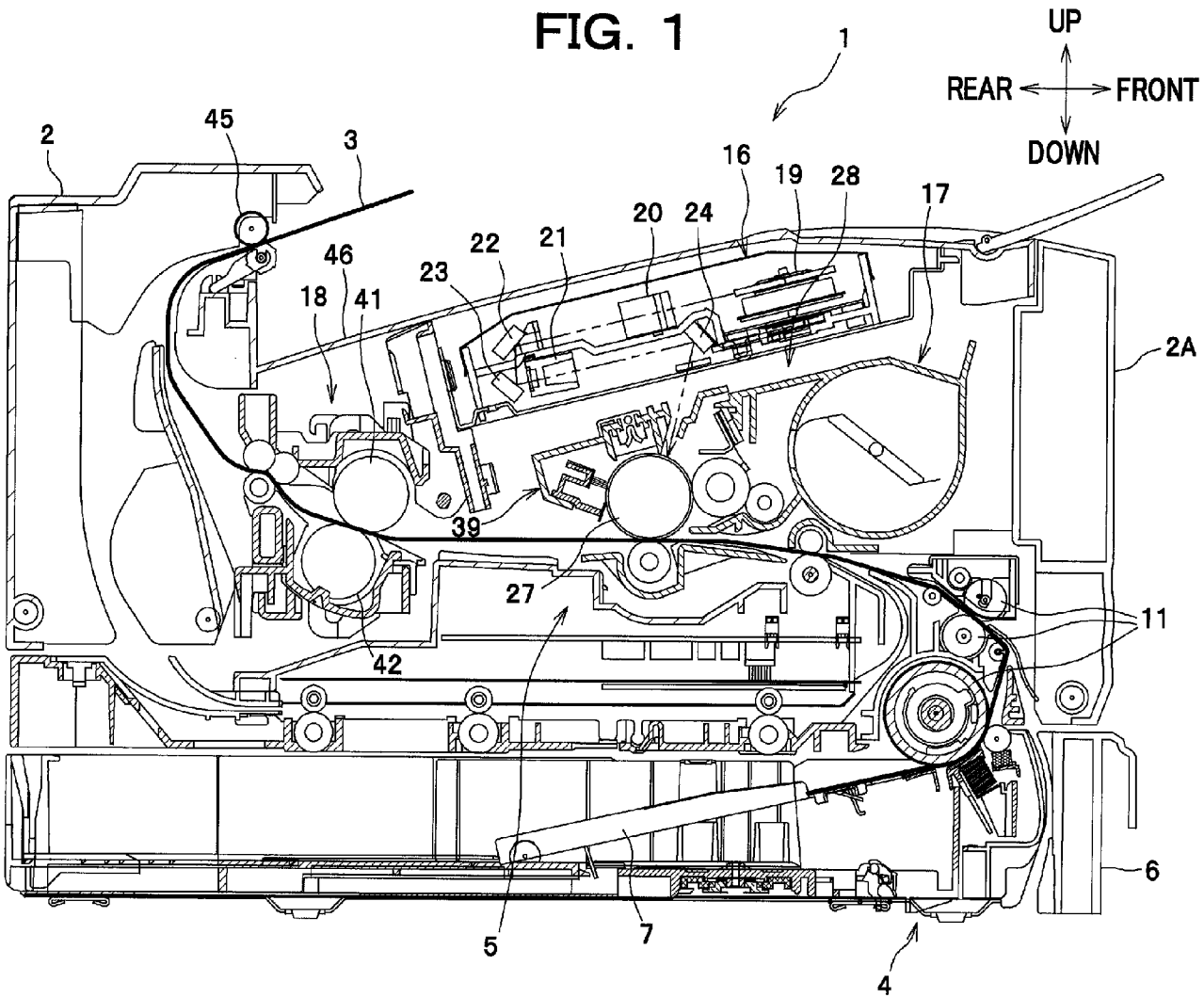
FIG. 1 is a side sectional view of a laser printer with a developing cartridge according to one exemplary embodiment of the present invention.

Detailed description will be given of an illustrative embodiment of the present invention with reference to the drawings. In the following description, a general arrangement of a laser printer 1 (image forming apparatus), to which a developing device according to the present invention is attached, will be described briefly, and thereafter features of the developing device will be described in detail.

In the following description, unless otherwise stated, directions of the laser printer 1 refer to the directions as seen from a user facing to the laser printer 1 during its use. To be more specific, with reference to FIG. 1, the right-hand side of the drawing sheet corresponds to the "front" side of the laser printer, the left-hand side of the drawing sheet corresponds to the "rear" side of the printer, the front side of the drawing sheet corresponds to the "left" side of the printer, and the back side of the drawing sheet corresponds to the "right" side of the printer. Similarly, the direction extending from top to bottom of the drawing sheet corresponds to the "vertical" or "up/down (upper/lower or top/bottom)" direction of the laser printer.

<General Arrangement of Laser Printer>

As seen in FIG. 1, the laser printer 1 comprises a body casing 2, and several components housed within the body casing 2 which principally includes a sheet feeder unit 4 for feeding a sheet 3 (e.g., of paper), and an image forming unit 5 for forming an image on the sheet 3.

The sheet feeder unit 4 principally includes a sheet feed tray 6 detachably attached to a lower space within the body casing 2, a sheet pressure plate 7 provided in the sheet feed tray 6, and various rollers 11 such as for conveying the sheet 3. Sheets 3 stored in the sheet feed tray 6 are urged upward by the sheet pressure plate 7, separated one from the other, and conveyed by the rollers 11 into the image forming unit 5.

The image forming unit 5 principally includes a scanner unit 16, a process cartridge 17, and a fixing unit 18.

The scanner unit 16 is provided in an upper space within the body casing 2. The scanner unit 16 is configured to cause a laser beam produced based upon image data to travel along a path indicated by chain double-dashed lines, by reflecting or transmitting the same at a polygon mirror 19, a lens 20, reflecting mirrors 22, 23, a lens 21, and a reflecting mirror 24 in this order, so that a peripheral surface of a photoconductor drum 27 is rapidly scanned and illuminated with the laser beam.

The process cartridge 17 is configured to be detachably attached to the body casing 2 through an opening formed when a front cover 2A provided at a front side of the body casing 2 is swung open. The process cartridge 17 principally includes a developing cartridge 28 as an example of the developing device and a drum unit 39.

The developing cartridge 28 is designed to be assembled together with the drum unit 39, and the assembly of the developing cartridge 28 and the drum unit 39 is then detachably attached to the body casing 2. It is to be noted that the developing cartridge 28 may be designed to be detachably attached to the drum unit 39 that is fixed to the body casing 2.

Figure 2:
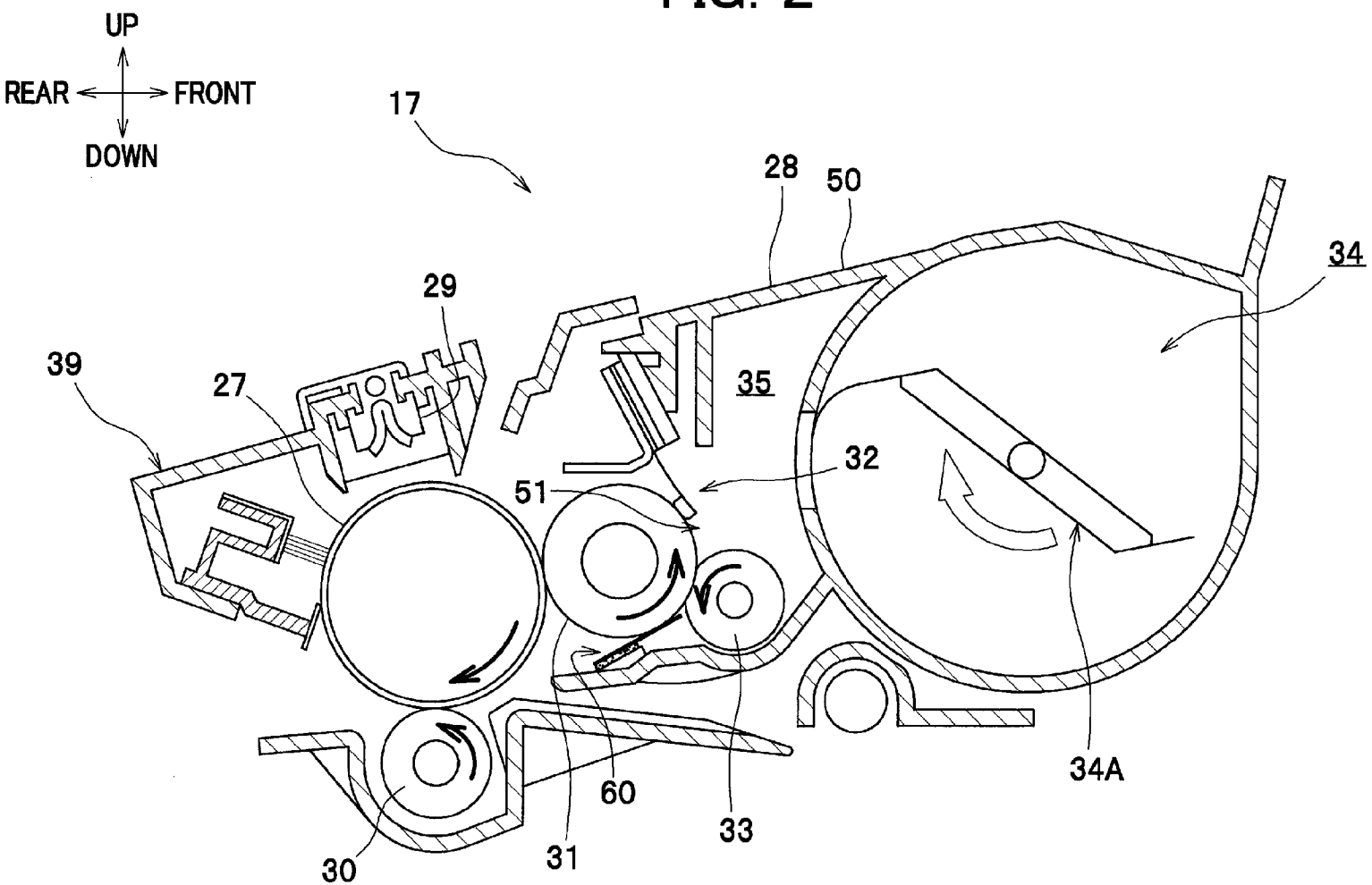
FIG. 2 is a side sectional view showing the developing cartridge.

As best seen in FIG. 2, the developing cartridge 28 principally includes a frame 50, a developing roller 31 as an example of a developer carrying member, a doctor blade 32, and a supply roller 33. The frame 50 defines therein a toner storage chamber 34 as an example of a developer storage portion and a developing chamber 35 adjacent to and in communication with the toner storage chamber 34.

According to this developing cartridge 28, toner (developer) is agitated by an agitator 34A in the toner storage chamber 34, and in the developing chamber 35, supplied from the supply roller 33 to the developing roller 31, during which the toner is charged positively between the supply roller 33 and the developing roller 31. As the developing roller 31 rotates, the toner supplied onto the developing roller 31 is moved between the doctor blade 32 and the developing roller 31, frictionally charged therebetween, and carried on the developing roller 31 as a thin layer of toner having a predetermined thickness.

A seal member 60 abuts against the developing roller 31 from below, so that the doctor blade 32 and the seal member 60 prevent toner within the developing chamber 35 from leaking out from top and bottom sides of the developing roller 31.

The drum unit 39 principally includes a photoconductor drum 27, a scorotron charger 29, and a transfer roller 30. In the drum unit 39, the peripheral surface of the photoconductor drum 27 is uniformly and positively charged by the scorotron charger 29, and then exposed to a rapidly sweeping laser beam from the scanner unit 16. Accordingly, the electric potential of the exposed area lowers, so that an electrostatic latent image based on the image data is formed on the photoconductor drum 27.

Further, as the developing roller 31 rotates, the positively charged toner that is carried on the peripheral surface of the developing roller 31 is supplied to the electrostatic latent image formed on the peripheral surface of the photoconductor drum 27. Accordingly, the electrostatic latent image is visualized and a toner image is formed on the surface of the photoconductor drum 27. Thereafter, while the sheet 3 is conveyed through between the photoconductor drum 27 and the transfer roller 30, the toner image carried on the surface of the photoconductor drum 27 is transferred onto the sheet 3.

As seen in FIG. 1, the fixing unit 18 principally includes a heating roller 41 and a pressure roller 42 pressed against the heating roller 41. In the fixing unit 18, the toner image (i.e., toner) transferred onto the sheet 3 is thermally fixed on the sheet 3 while the sheet 3 passes through between the heating roller 41 and the pressure roller 42. After the sheet 3 passes through the fixing unit 18 and the toner image is thermally fixed on the sheet 3, the sheet 3 is conveyed to the sheet eject roller 45 disposed at a downstream side of the fixing unit 18, and ejected by the sheet eject roller 45 onto a sheet output tray 46.

<Detailed Structure of Developing Cartridge>

Detailed description will be given of the structure of the developing cartridge 28.

Figure 3:
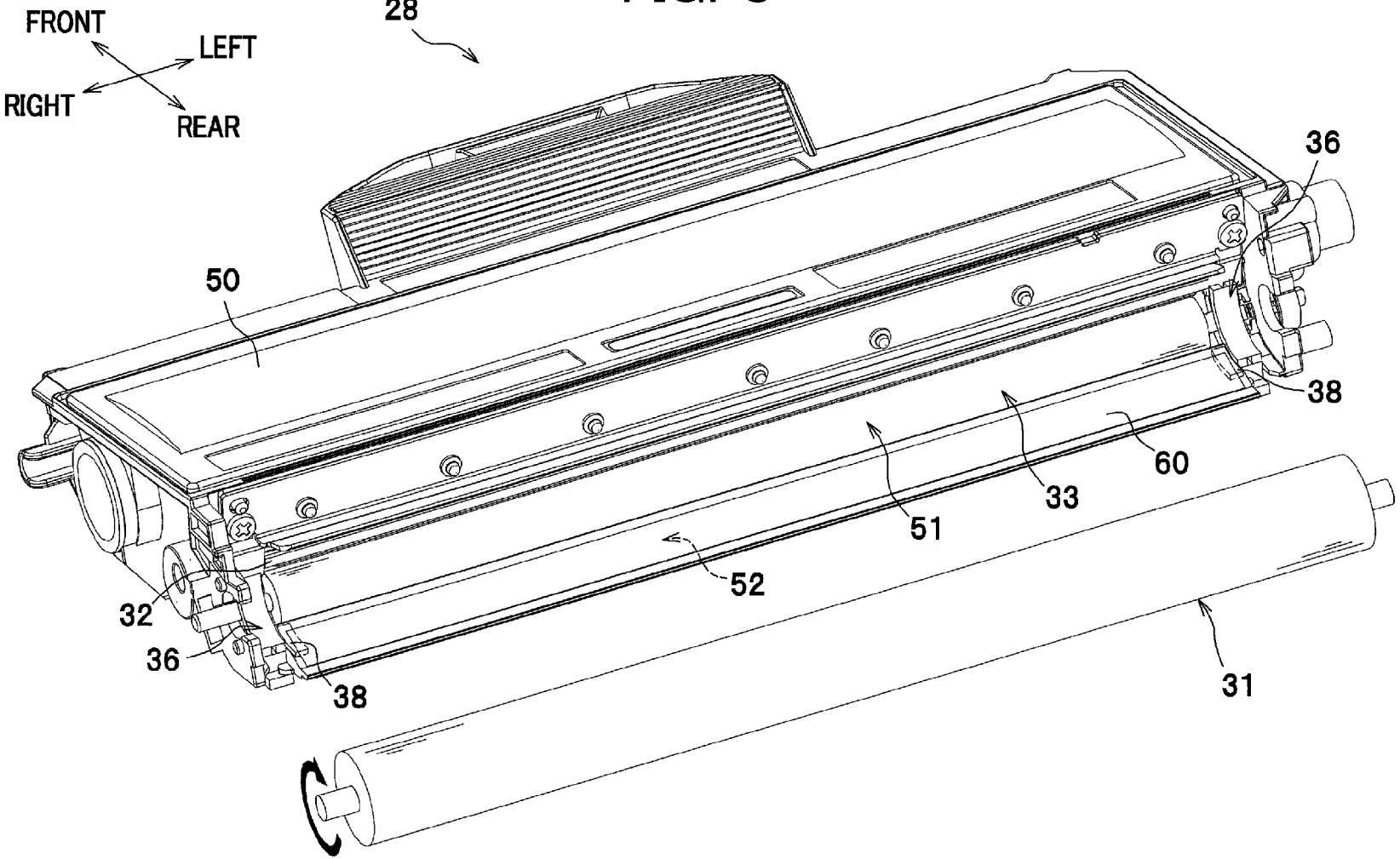
FIG. 3 is a perspective view of the developing cartridge with a side cover and a developing roller removed.

As seen in FIG. 3, the frame 50 is configured to store toner, and includes a longitudinal toner supply opening 51 (i.e., developer supply opening) formed in a side wall that is positioned at the rear side (i.e., front side of FIG. 3) of the frame 50.

The supply roller 33 extending along the toner supply opening 51 is rotatably supported on the frame 50 within the developing chamber 35, and the developing roller 31 is rotatably supported on the frame 50 outside the developing chamber 35 such that the toner supply opening 51 is closed by the developing roller 31.

Figure 4:
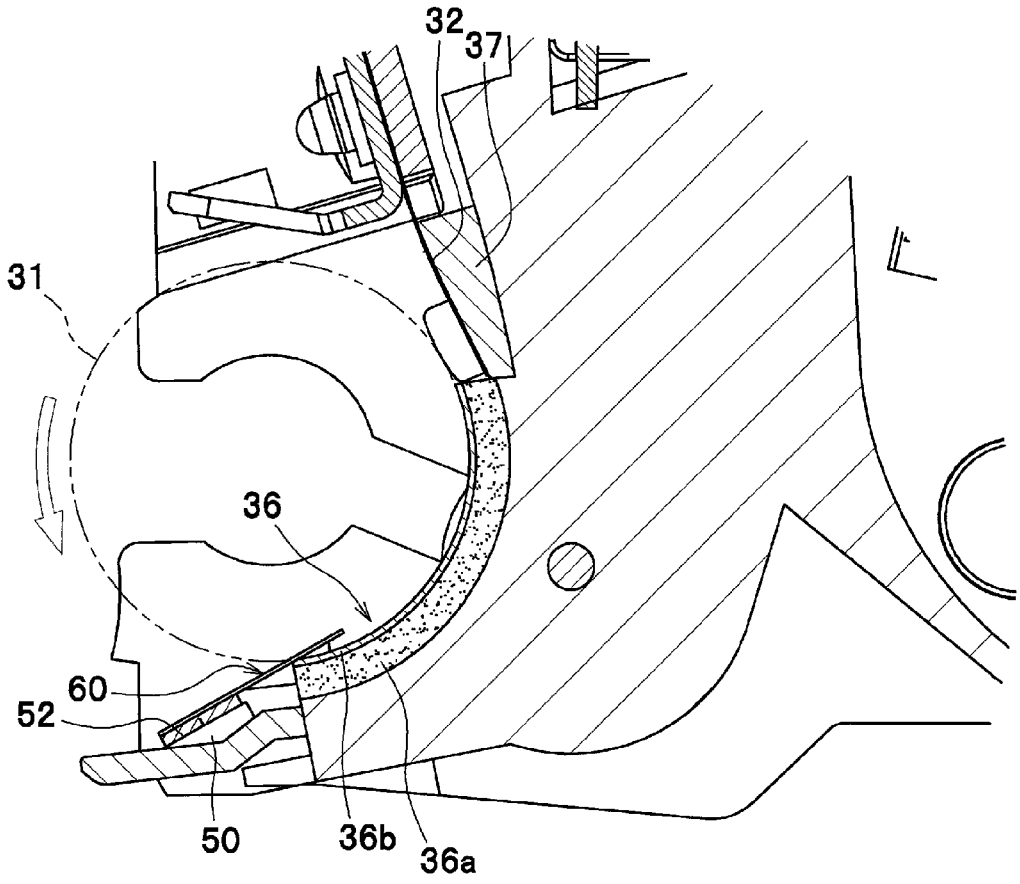
FIG. 4 is an enlarged sectional view showing around a seal member at the left side of the developing cartridge.

The doctor blade 32 extends in the right-left direction at an upper edge of the tonner supply opening 51, and a pair of side seals 36 are provided at both right and left edges of the toner supply opening 51. As best seen in FIG. 4, each side seal 36 has a two-layer structure comprising, for example, an elastic urethane rubber layer 36*a*, and a Teflon felt layer 36*b* adhered on the surface of the urethane rubber layer 36*a* and allowing the developing roller 31 to slide on the surface thereof. Further, in order to prevent toner leakage from a gap between the doctor blade 32 and the frame 50, a blade back seal 37 made of urethane sponge is provided on the doctor blade 32.

A seal member 60 is provided at a lower edge of the tone supply opening 51. Further, as best seen in FIG. 3, a pair of lower side seals 38 are provided inwardly of and adjacent to the side seals 36. Both end portions in the longitudinal side of the seal member 60 are placed on the lower side seals 38, so that toner leakage from a gap between each of the side seals 36 and the seal member 60 can be prevented.

By sealing the periphery of the toner supply opening 51 in this manner, it is possible to prevent toner leakage from the developing chamber 35.

The seal member 60 is a longitudinal member extending along the axial direction of the developing roller 31. As seen in FIG. 4, as viewed in a lateral direction of the seal member 60 (i.e., direction orthogonal to the longitudinal direction of the seal member 60), one end portion of the seal member 60 is fixed to a seal supporting surface 52 of the frame 50, and the other end portion of the seal member 60 is in contact with the outer peripheral surface of the developing roller 31. The seal supporting surface 52 extends along the axial direction of the developing roller 31, so as to support thereon a lateral end portion of the seal member 60. Therefore, the seal member 60 is supported on the frame 50 in a cantilevered fashion, and provides a seal between the frame 50 and the outer peripheral surface of the developing roller 31.

It is to be noted that the state in which the seal member 60 is supported on the frame 50 "in a cantilevered fashion" indicates that one lateral end portion of the seal member 60 is fixed to the frame 50 while the other lateral end portion becomes a free end.

Figure 5A:
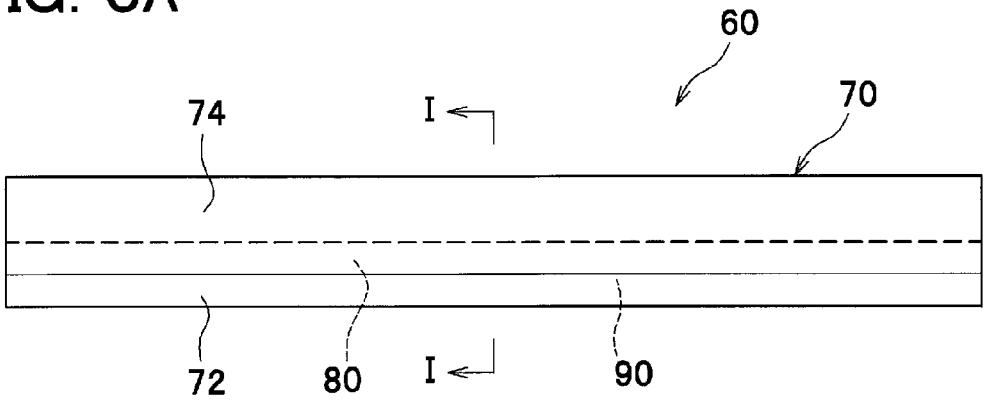
FIG. 5A is a top view of the seal member.

As best seen in FIG. 5A, the seal member 60 includes a lower film 70 as an example of a longitudinal sheet-like member, which has one end portion 72 fixed to the seal supporting surface 52 of the frame 50 and the other opposite end portion 74 in contact with the outer peripheral surface of the developing roller 31, and an elastic adhesive member 80 having elasticity and configured to fix the one end portion 72 of the lower film 70 to the frame 50.

The lower film 70 is a transparent sheet-like member and made, for example, of polyethylene terephthalate (PET).

Figure 5B:
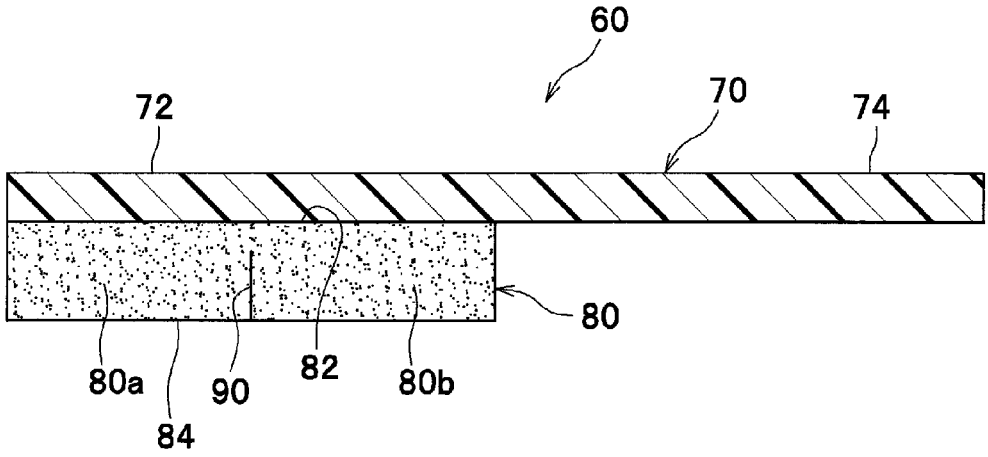
FIG. 5B is an enlarged sectional view taken along the line I-I of FIG. 5A.

As seen in FIG. 5B, the elastic adhesive member 80 has a first surface 82 adhered to the one end portion 72 of the lower film 70 and a second surface 84 adhered to the seal supporting surface 52 of the frame 50, and a slit 90 is formed from the second surface 84 toward the first surface 82. The slit 90 extends halfway through the elastic adhesive member 80 without reaching the first surface 82, and two adjacent adhesive members 80*a*, 80*b* are formed at both sides of the slit 90. As best seen in FIG. 5A, the slit 90 extends longitudinally and continuously from one end to the other end of the elastic adhesive member 80.

The elastic adhesive member 80 has sufficient thickness and elasticity such that when the seal member 60 is adhered to the seal supporting surface 52 of the frame 50, fine surface irregularities present on the seal supporting surface 52 are absorbed by the elastic adhesive member 80 to prevent toner leakage from the adhesion interface between the seal supporting surface 52 and the elastic adhesive member 80. Since the elastic adhesive member 80 has elasticity, a load is readily distributed over the entire adhesion interface between the seal member 60 and the seal supporting surface 52. This can prevent adhesion failure due to insufficient application of a load.

Figure 6A:
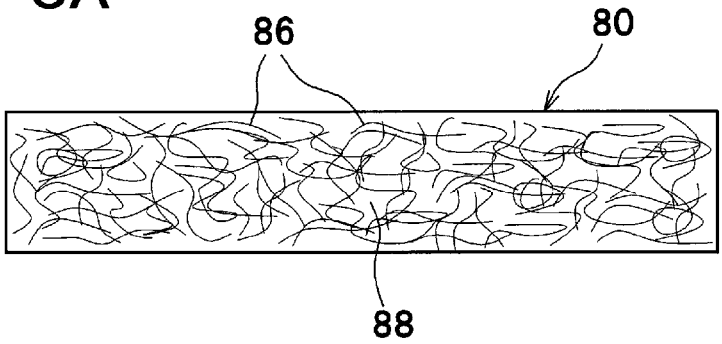
FIG. 6A is a sectional view showing the configuration of an elastic adhesive member, which is made of nonwoven fabric soaked with adhesive.

As seen in FIG. 6A, the elastic adhesive member 80 is made of nonwoven fabric 86 as an example of a base material and adhesive 88 soaked into the nonwoven fabric 86. Preferably, the thickness of the elastic adhesive member 80 is equal to or more than 0.2 mm, and more preferably, equal to or more than 0.4 mm.

The elastic adhesive member 80 may consist of, for example, "UT1140" manufactured by Sony Chemical & Information Device Corporation.

Figure 6B:
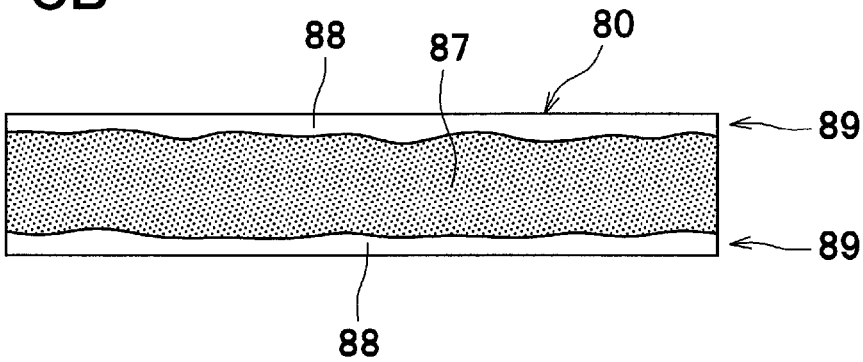
FIG. 6B is a sectional view showing another configuration of the elastic adhesive member, which includes a base material and adhesive layers positioned on both sides of the base material.

As seen in FIG. 6B, the elastic adhesive member 80 as a modification may comprise a base material 87, and adhesive layers 89 made of adhesive 88 and positioned on both top and bottom surfaces of the base material 87. The base material 87 is made of an elastic material such as rubber or sponge, and provides elasticity to the elastic adhesive member 80. Using such a base material 87 makes it possible to lessen the amount of adhesive required, and as a result, oozing of the adhesive can be prevented.

In the case where the base material 87 is made of sponge and voids of the sponge communicate with each other, the adhesive 88 may be soaked into the base material 87, in place of the elastic adhesive member 80 shown in FIG. 6A.

The elastic adhesive member 80 is not limited to such a structure that only the substrate 87 has elasticity, and elastic adhesive may be used for the adhesive layers 89 to provide elastic adhesive layers. In other words, as long as the elastic adhesive member 80 has elasticity as a whole, one of or both of the base material 87 and the adhesive layers 89 may have elasticity.

When the seal member 60 is adhered to the developing cartridge 28, a protecting sheet (not shown) for covering the second surface 84 of the elastic adhesive member 80 is first removed. Before assembling the developing roller 31 such as shown in FIG. 3, the seal member 60 is adhered to the seal supporting surface 52 of the frame 50 along the lower edge of the toner supply opening 51. Thereafter, pressure is applied to the lower film 70 from above, so that the second surface 84 of the elastic adhesive member 80 is deformed to conform with surface irregularities of the seal supporting surface 52 to thereby bring the elastic adhesive member 80 in close contact with the seal supporting surface 52.

Since the elastic adhesive member 80 has elasticity, a pressure bonding process as described above can be carried out smoothly.

Further, the seal member 60 is configured such that the lower film 70 is transparent and both of the nonwoven fabric 86 and the adhesive 88 are also translucent, so that the elastic adhesive member 80 made of the nonwoven fabric 86 soaked with the adhesive 88 also becomes translucent. This is advantageous because when the elastic adhesive member 80 is adhered to the seal supporting surface 52, the adhesion state can be seen from above through the lower film 70.

Accordingly, a worker can pressurize the seal member 60 to remove air bubbles inside the elastic adhesive member 80 while checking the adhesion state. It is therefore possible to prevent the elastic adhesive member 80 from being insufficiently adhered to the seal supporting surface 52, which can lead to an improvement in the workability of the pressure bonding process.

Further, in the case where the elastic adhesive member 80 is made of the nonwoven fabric 86 soaked with the adhesive 88, as compared with the case where only the adhesive 88 is used as the elastic adhesive member 80, the adhesive 88 has larger thickness and elasticity can be obtained efficiently.

Explanation will be given on how the seal member deforms during the process in which a pressing force is applied from the developing roller to the seal member adhered to the seal supporting surface 52 of the frame 50.

Figure 7A:
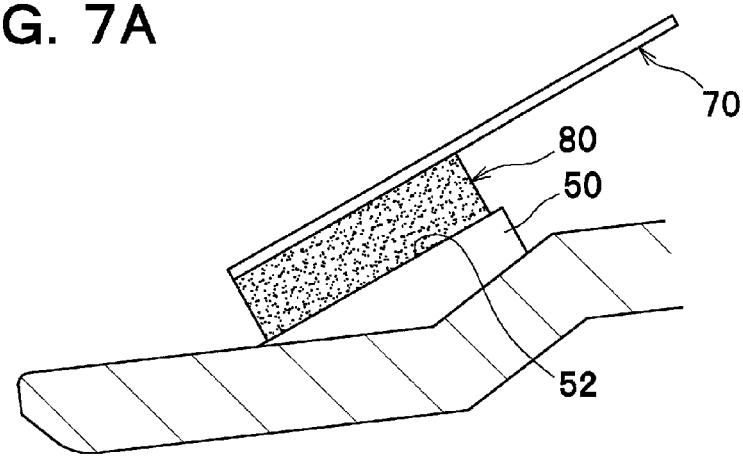
FIGS. 7A to 7C are explanatory views of a seal member according to a comparative example, illustrating a process in which the elastic adhesive member deforms and peels off from the frame due to a force applied to the adhesion interface between the seal member and the frame.
Figure 7B:
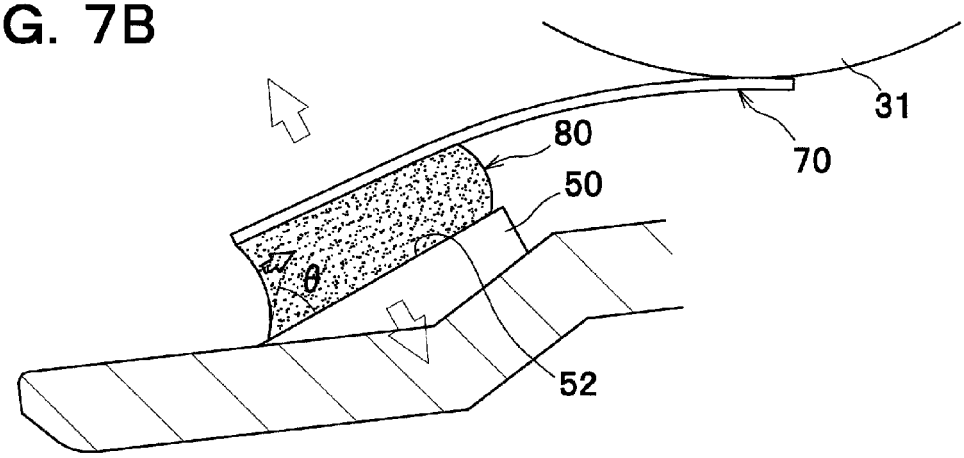
Figure 7C:
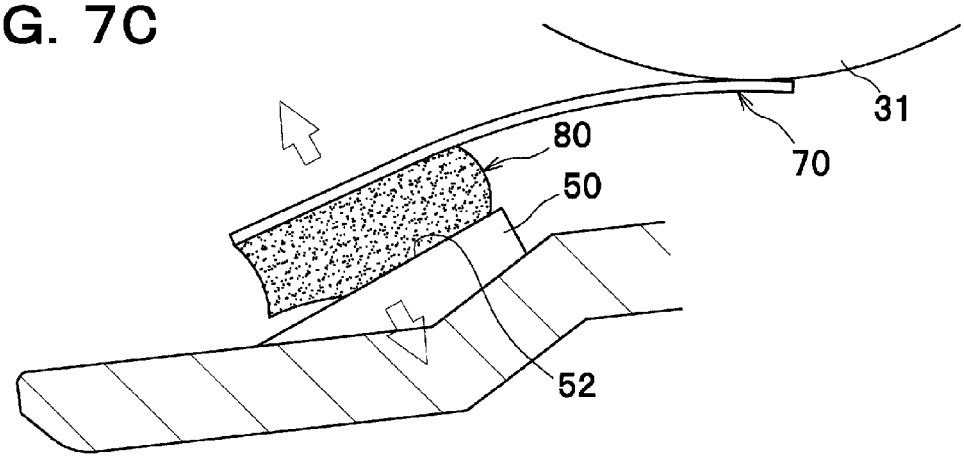

At first, with reference to FIGS. 7A to 7C, a comparative example is described. As best seen in FIG. 7A, in a state where no pressing force is applied from the developing roller (e.g., just after attachment of the seal member while the developing roller is not attached to the frame), the angle between both ends of the elastic adhesive member 80 and the frame 50, at the adhesion interface between the seal supporting surface 52 of the frame 50 and the seal member, is substantially 90 degrees.

However, as best seen in FIG. 7B, when the developing roller 31 is attached to the frame 50, moment is generated at one end portion of the seal member that is fixed to the seal supporting surface 52 because the outer peripheral surface of the developing roller 31 is brought into contact with the other end portion of the seal member and a pressing force is applied thereto. As a result, as schematically shown in FIG. 7B, a force is applied in a direction such that the lower film 70 and the seal supporting surface 52 are separated from each other, so that the elastic adhesive member 80 deforms to extend upward. At this time, a force is applied to the elastic adhesive member 80 at its far end portion away from the developing roller 31 such that the elastic adhesive member 80 is pulled inward toward the other end portion close to the developing roller 31. Therefore, at the adhesion interface between the seal supporting surface 52 and the seal member, a peeling force which acts on the one end portion of the elastic adhesive member 80 becomes greater (i.e., angle θ at the far end portion of the elastic adhesive member 80 becomes smaller).

With further progress of the deformation of the elastic adhesive member 80, as best seen in FIG. 7C, the elastic adhesive member 80 starts to peel off from the seal supporting surface 52 at its far end portion away from the developing roller 31. If the peeling of the elastic adhesive member 80 further spreads, a sufficient seal between the frame 50 and the outer peripheral surface of the developing roller 31 is unable to be obtained, with the result that toner may leak out from a gap between the developing roller 31 and the lower film 70 or through the adhesion interface between the elastic adhesive member 80 and the seal supporting surface 52.

Figure 8A:
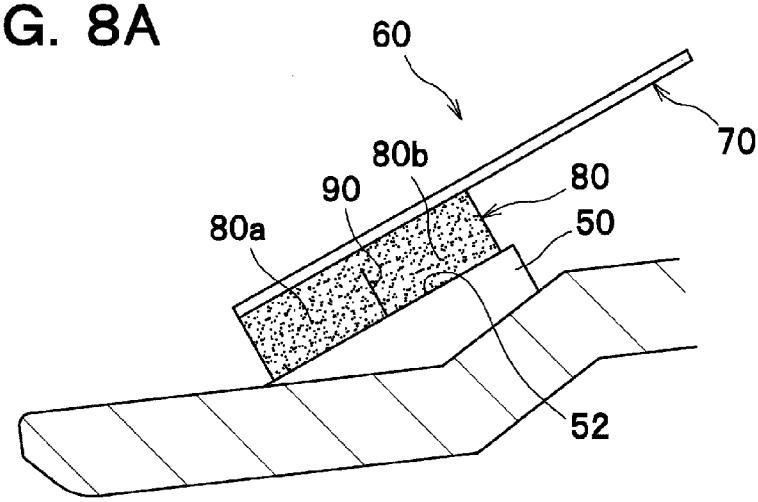
FIGS. 8A and 8B are explanatory views of a seal member according to the present invention, illustrating a process in which the elastic adhesive member having a slit deforms due to a force applied to the adhesion interface between the seal member and the frame.
Figure 8B:
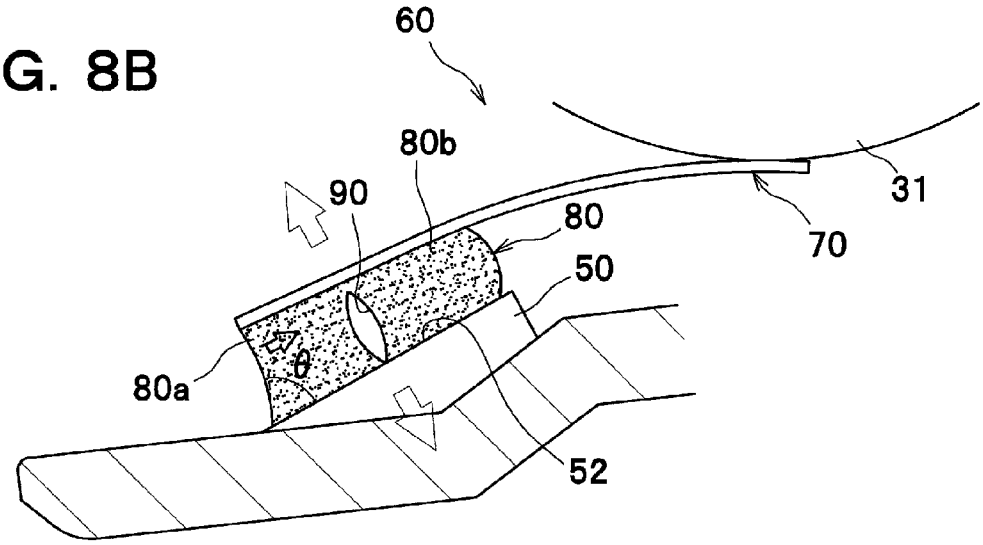

Next, with reference to FIGS. 8A and 8B, description is given of the seal member 60 according to the present invention, in which a slit 90 is formed in the elastic adhesive member 80. As best seen in FIG. 8A, in a state where no pressing force is applied from the developing roller, the angle between both ends of the elastic adhesive member 80 and the frame 50, at the adhesion interface between the seal supporting surface 52 of the frame 50 and the seal member 60, is substantially 90 degrees.

Once moment is generated at one end portion of the seal member 60 that is fixed to the seal supporting surface 52, as schematically shown in FIG. 8B, a force is applied in a direction such that the lower film 70 and the seal supporting surface 52 are separated from each other, so that the elastic adhesive member 80 deforms to extend upward. By this deformation, a force is applied to the elastic adhesive member 80 at its far end portion away from the developing roller 31 such that the elastic adhesive member 80 is pulled inward toward the other end portion close to the developing roller 31. However, since the slit 90 is formed in the elastic adhesive member 80, the elastic adhesive member 80 can also deform at side surfaces facing the slit 90. The amount of deformation for inwardly pulling the elastic adhesive member 80 is therefore distributed, and a force applied to the elastic adhesive member 80 at its far end portion during deformation thereof does not become greater. In other words, according to this seal member 60, the angle θ at the far end portion of the elastic adhesive member 80 is not as small as that in the comparative example shown in FIG. 7B. Accordingly, the elastic adhesive member 80 is less likely to peel off from the seal supporting surface 52, and toner leakage from the developing cartridge can be suppressed while the seal member 60 maintains sufficient sealability.

According to the developing cartridge 28 as described above in this embodiment, the following advantageous effects can be achieved.

Since the slit 90 is formed along the axial direction of the developing roller 31 from the second surface 84 toward the first surface 82 of the elastic adhesive member 80, when the developing roller 31 contacts by pressure with the free end portion (the other opposite end portion 74) of the lower film 70 that is supported in a cantilevered fashion and thereby a pulling force is applied to the one end portion 72 of the lower film 70 that is fixed to the seal supporting surface 52 of the frame 50, deformation of the elastic adhesive member 80 can be suppressed and a reliable seal can be obtained between the frame 50 and the outer peripheral surface of the developing roller 31.

Since the elastic adhesive member 80 shown in FIG. 6A is made of nonwoven fabric 86 soaked with adhesive 88 and the lower film 70 is a transparent member, when the elastic adhesive member 80 is adhered to the frame 50, the adhesion state can be seen from above through the lower film 70. Accordingly, a worker can pressurize the seal member 60 to remove air bubbles inside the elastic adhesive member 80 while checking the adhesion state. This makes it possible to reliably bring the elastic adhesive member 80 in close contact with the seal supporting surface 52, and thus the workability of the pressure bonding process can be improved. Since the slit 90 is sized to extend halfway through the elastic adhesive member 80 without reaching the first surface 82, when a cutting blade is applied from the reverse side of the seal member 60 (i.e., from the elastic adhesive member 80) to form the slit 90, the slit 90 can be easily formed without damaging the lower film 70.

Since the elastic adhesive member 80 shown in FIG. 6B includes the base material 87 and the adhesive layers 89 positioned on both sides of the base material 87 and providing the first surface 82 and the second surface 84, the elastic adhesive member 80 has a sufficient thickness to undergo large deformation. Further, since the elastic adhesive member 80 includes the base material 87, the two adjacent adhesive members 80*a*, 80*b* positioned on both sides of the slit 90 that is formed in the elastic adhesive member 80 are less likely to reattach together, which leads to improved independence between the two adjacent adhesive members 80*a*, 80*b*.

Since the slit 90 formed in the elastic adhesive member 80 extends continuously along the axial direction of the developing roller 31 from one end to the other end of the elastic adhesive member 80, the seal member 60 is not likely to peel off from the frame 50 over the whole longitudinal region of the elastic adhesive member 80.

Although one exemplary embodiment of the present invention has been described above, the present invention is not limited to this specific embodiment. It is to be understood that various changes and modifications may be made where necessary without departing from the scope of the appended claims.

Figure 9A:
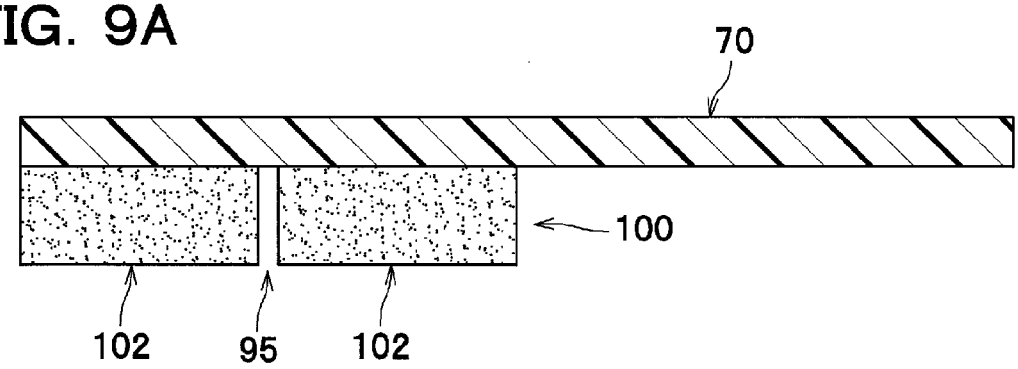
FIG. 9A is an enlarged sectional view of an elastic adhesive member according to a modified embodiment, in which a slit is formed by a gap defined between two discrete adhesive members.

In the above-described embodiment, the slit 90 is formed continuously along the longitudinal direction of the elastic adhesive member 80 from one end to the other end of the elastic adhesive member 80 and extends halfway through the elastic adhesive member 80 without reaching the first surface 82. However, the present invention is not limited to this specific configuration. For example, as best seen in FIG. 9A, the elastic adhesive member 100 may include two discrete adhesive members 102, and a slit 95 may be formed by a gap that is defined between the two adhesive members 102 disposed spaced apart from each other.

In this instance, the two adhesive members 102 may have the same configuration as that of the elastic adhesive member 80 shown in FIG. 6A. Of course, the configuration of the elastic adhesive member 80 shown in FIG. 6B may be adopted to the two adhesive members 102.

Figure 9B:
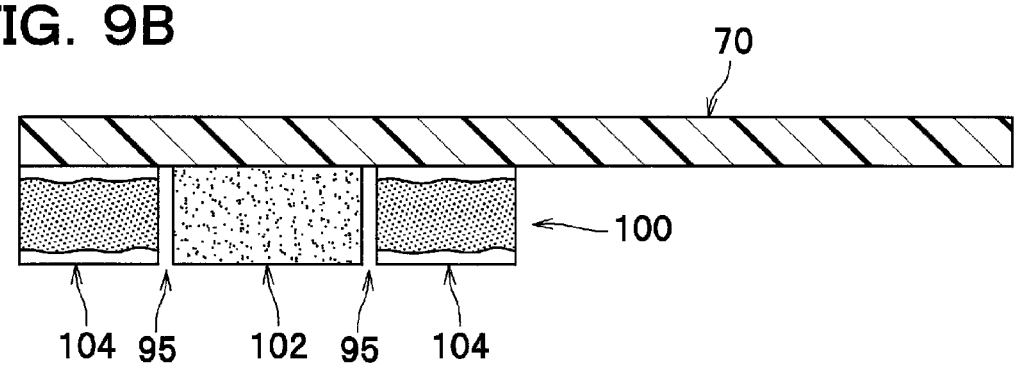
FIG. 9B is an enlarged sectional view of an elastic adhesive member according to another modified embodiment, in which two slits are formed by gaps defined between three discrete adhesive members.

Further, as best seen in FIG. 9B, the elastic adhesive member 100 may include three discrete adhesive members 102, 104, and two slits 95 may be formed by gaps that are defined between the three adhesive members 102, 104 disposed spaced apart from one another.

In this instance, for example, the adhesive member 102 may have the same configuration as that of the elastic adhesive member 80 shown in FIG. 6A, and the adhesive members 104 may have the same configuration as that of the elastic adhesive member 80 shown in FIG. 6B.

Each of the adhesive members 102, 104 is shaped like a thin strip. The adhesive members 102, 104 are adhered to the one end portion 72 of the lower film 70 and arranged parallel to one another.

As long as a sufficient adhesion area of the elastic adhesive member 100 with respect to the frame 50 can be ensured, a number of narrow adhesive members may be used for the purpose of increasing the number of slits 95.

According to the above modified embodiments, since the slit 95 (or slits 95) extends through the elastic adhesive member 100 from the second surface to the first surface, two adjacent adhesive members divided by the slit 95 and positioned on both sides of the slit 95 are less likely to reattach together, which leads to improved independence between the two adjacent adhesive members.

Further, since the elastic adhesive member 100 includes a plurality of discrete adhesive members and each slit 95 is formed by a gap that is defined between the plurality of adhesive members disposed spaced apart from one another, two adjacent adhesive members are much less likely to reattach together, which leads to more improved independence between the two adjacent adhesive members.

According to the elastic adhesive member 100 shown in FIG. 9A, since the plurality of adhesive members are made of same materials, the manufacturing cost can be saved.

According to the elastic adhesive member 100 shown in FIG. 9B, since plural lines of slits 95 are arranged in a lateral direction of the elastic adhesive member 100, namely in a direction intersecting with the axial direction of the developing roller 31, even if the adhesive member 104 that is positioned at the side of the elastic adhesive member 100 farthest away from the developing roller 31 peels off from the seal supporting surface 52 of the frame 50, the remaining adhesive members 102, 104 can prevent the seal member from peeling off from the seal supporting surface 52. In other words, the number of edges of the adhesive members 102, 104 formed on both sides of the slits 95 can be increased for the purpose of preventing peeling of the elastic adhesive member 100.

As described previously, in the above-described embodiments, the slits 90, 95 extend continuously along the longitudinal direction of the elastic adhesive member 80, 100 from one end to the other end of the elastic adhesive member. However, the present invention is not limited to this specific configuration. For example, as seen in FIGS. 10A-10D, various patterned slits may be employed.

Figure 10A:
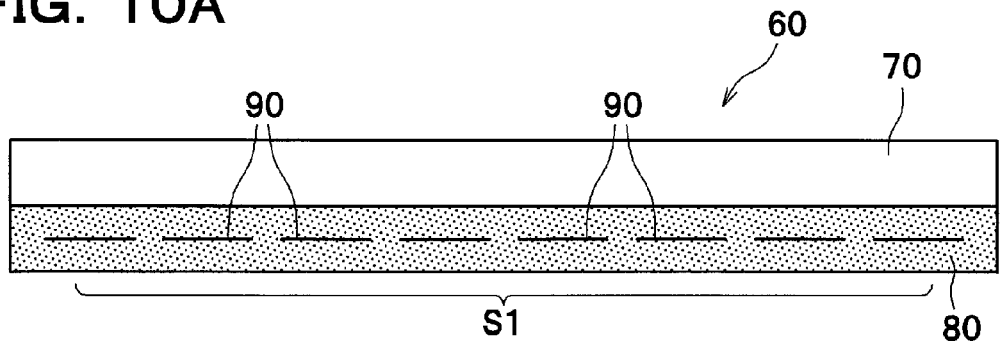
FIGS. 10A to 10D are bottom views of seal members as viewed from the reverse side, illustrating modifications of a plurality of slits formed along the longitudinal direction of the elastic adhesive member.

As seen in FIG. 10A, a slit pattern S1 is formed by a plurality of slits 90 arranged in line along the longitudinal direction of the elastic adhesive member 80.

Figure 10B:
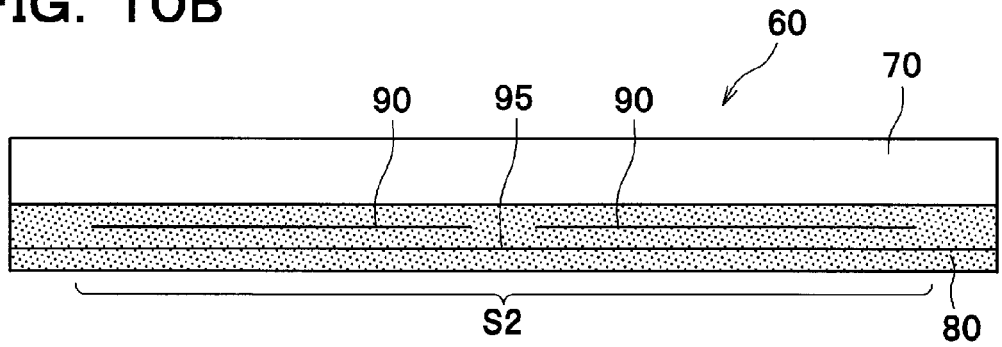

As seen in FIG. 10B, a slit pattern S2 is formed by the combination of one slit 95 extending along the longitudinal direction of the elastic adhesive member 80 from one end to the other end thereof and a plurality of slits 90 arranged in line along the longitudinal direction of the elastic adhesive member 80.

Figure 10C:
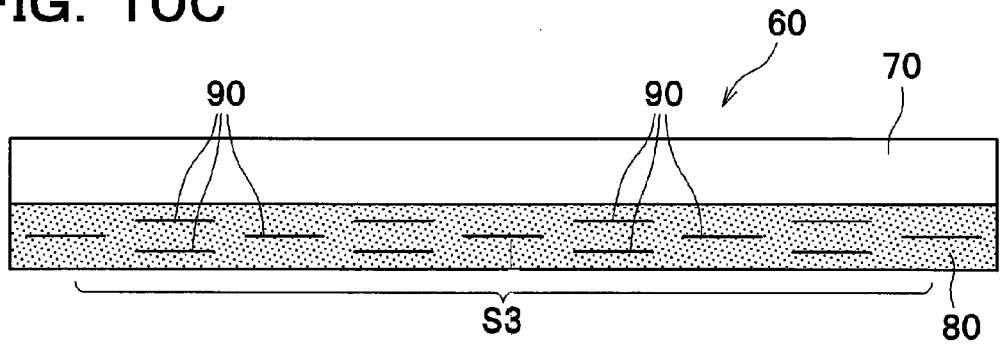

As seen in FIG. 10C, a slit pattern S3 is formed by a plurality of slits 90 arranged in three rows and discontinuously extending along the longitudinal direction of the elastic adhesive member 80. In some transverse sections of the elastic adhesive member 80, any slits are not present.

Figure 10D:
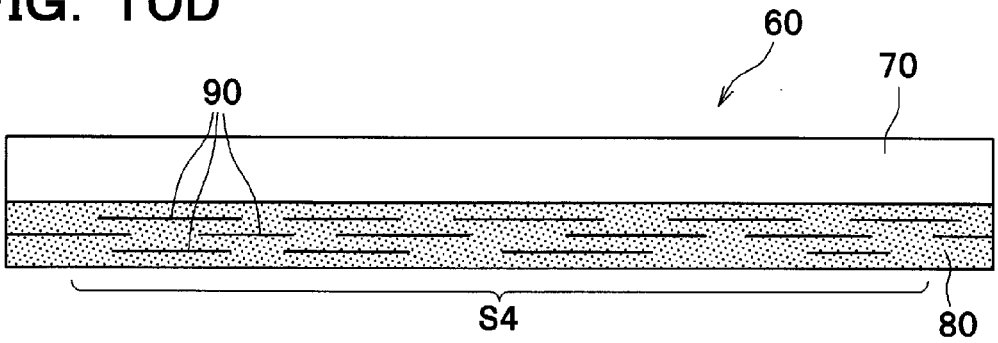

As seen in FIG. 10D, a slit pattern S4 is formed by a plurality of slits 90 arranged at random. However, in any transverse sections of the elastic adhesive member 80, at least one slit 90 is present. In other words, plural lines of slits are arranged along the longitudinal direction of the elastic adhesive member 80 over the entire range of the elastic adhesive member 80.

It should be understood that in the above slit patterns S1-S4, each of the slits may extend through the elastic adhesive member from the second surface to the first surface or extend halfway through the elastic adhesive member without reaching the first surface.

According to the developing cartridge to which the seal member 60 having one of the slit patterns S1-S4 is attached, it is also possible to suppress the elastic adhesive member from peeling off from the seal supporting surface of the frame and a reliable seal can be obtained between the frame 50 and the developing roller 31.

In particular, according to the developing cartridge to which the seal member 60 having one of the slit patterns S2 to S4 is attached, plural lines of slits 90, 95 are arranged in a lateral direction of the elastic adhesive member 80, namely in a direction intersecting with the axial direction of the developing roller 31. It is therefore possible to increase the number of edges for preventing peeling of the elastic adhesive member 80.

Further, according to the developing cartridge to which the seal member 60 having the slit pattern S2 or the slit pattern S4 is attached, the plural lines of slits 90, 95 are arranged along the axial direction of the developing roller 31 over the entire range of the elastic adhesive member 80. It is therefore possible to suppress peeling of the elastic adhesive member 80 over the whole longitudinal region of the elastic adhesive member 80.

In the above-described embodiments, the seal member 60 is attached to the frame 50 of the developing cartridge 28. However, the present invention is not limited to this specific configuration. For example, the present invention is also applicable to an image forming apparatus comprising a toner cartridge, by which a toner storage chamber is replaceable while other components such as the drum unit 39, the developing roller 31, and the developing chamber 35 are fixed to the main body.

What is claimed is:

1. A developing device comprising:

a developing roller;

a frame including a developer storage portion configured to store developer, and a developer supply opening in communication with the developer storage portion and extending along an axial direction of the developing roller; and a seal member configured to seal between the frame and an outer peripheral surface of the developing roller, the seal member being provided on the frame and extending along the axial direction of the developing roller, wherein the frame has a seal supporting surface extending along the axial direction of the developing roller, on which the seal member is supported in a cantilevered fashion, wherein the seal member comprises a sheet-like member and an elastic adhesive member having elasticity, and the elastic adhesive member extends along a longitudinal edge of the developer supply opening, which longitudinal edge extends along the axial direction of the developing roller, and the sheet-like member has one end portion fixed to the seal supporting surface through the elastic adhesive member and the other end portion in contact with the outer peripheral surface of the developing roller, and wherein the elastic adhesive member has a first surface adhered to the sheet-like member and a second surface adhered to the seal supporting surface, and at least one slit is formed in the elastic adhesive member along the axial direction of the developing roller from the second surface toward the first surface.

2. The developing device according to claim 1, wherein the elastic adhesive member is made of nonwoven fabric soaked with adhesive, and the sheet-like member is a transparent member.

3. The developing device according to claim 1, wherein the slit extends halfway through the elastic adhesive member without reaching the first surface.

4. The developing device according to claim 1, wherein the slit extends through the elastic adhesive member to the first surface.

5. The developing device according to claim 4, wherein the elastic adhesive member comprises a plurality of discrete adhesive members, and wherein the slit is formed by a gap that is defined between the plurality of adhesive members disposed spaced apart from one another.

6. The developing device according to claim 5, wherein the plurality of adhesive members are made of same materials.

7. The developing device according to claim 1, wherein the elastic adhesive member comprises a base material, and adhesive layers positioned on both sides of the base material and providing the first surface and the second surface.

8. The developing device according to claim 1, wherein plural lines of slits are arranged in a direction intersecting with the axial direction of the developing roller.

9. The developing device according to claim 1, wherein the slit extends continuously along the axial direction of the developing roller from one end to the other end of the elastic adhesive member.

10. The developing device according to claim 8, wherein the plural lines of slits are arranged along the axial direction of the developing roller over an entire range of the elastic adhesive member.

* * * * *

UNITED STATES PATENT AND TRADEMARK OFFICE

CERTIFICATE OF CORRECTION

PATENT NO. : 8,620,177 B2
APPLICATION NO. : 13/071476
DATED : December 31, 2013
INVENTOR(S) : Juan Torres Carot It is certified that error appears in the above-identified patent and that said Letters Patent is hereby corrected as shown below:

On the Title Page, Item (54) and in the Specification, Column 1, Line 1, Title: please change "MEMBERS" to --MEMBER--.

Signed and Sealed this
Twenty-ninth Day of July, 2014

Michelle K. Lee

Michelle K. Lee
*Deputy Director of the United States Patent and Trademark Office*